US008763505B2

(12) United States Patent
Ishihara

(10) Patent No.: US 8,763,505 B2
(45) Date of Patent: Jul. 1, 2014

(54) CUTTER

(75) Inventor: Muneyuki Ishihara, Katsushika-ku (JP)

(73) Assignee: Carl Manufacturing Co., Ltd., Tokyo (JP)

( * ) Notice: Subject to any disclaimer, the term of this patent is extended or adjusted under 35 U.S.C. 154(b) by 344 days.

(21) Appl. No.: 13/202,709

(22) PCT Filed: Feb. 24, 2010

(86) PCT No.: PCT/JP2010/052905
§ 371 (c)(1),
(2), (4) Date: Sep. 12, 2011

(87) PCT Pub. No.: WO2010/106886
PCT Pub. Date: Sep. 23, 2010

(65) Prior Publication Data

US 2011/0314992 A1 Dec. 29, 2011

(30) Foreign Application Priority Data

Mar. 16, 2009 (JP) ..... 2009-063668

(51) Int. Cl.
*B26D 1/06* (2006.01)

(52) U.S. Cl.
USPC ..... 83/485; 83/455; 83/614; 83/487

(58) Field of Classification Search
USPC ..... 83/483, 485, 614, 487, 613, 455, 564, 83/563; 30/291, 292, 319, 320
See application file for complete search history.

(56) References Cited

U.S. PATENT DOCUMENTS

| | | | | |
|---|---|---|---|---|
| 5,069,097 | A * | 12/1991 | Mori | 83/56 |
| 2007/0028463 | A1 | 2/2007 | Chan | |
| 2007/0028738 | A1 | 2/2007 | Chan | |
| 2007/0125214 | A1 * | 6/2007 | Dong et al. | 83/485 |

FOREIGN PATENT DOCUMENTS

| | | |
|---|---|---|
| JP | A-9-123088 | 5/1997 |
| JP | A-9-168996 | 6/1997 |
| JP | A-2000-42979 | 2/2000 |
| JP | A-2001-150383 | 6/2001 |
| JP | A-2002-239266 | 8/2002 |
| JP | A-2007-38403 | 2/2007 |

OTHER PUBLICATIONS

International Search Report issued in International Application No. PCT/JP2010/052905 on Mar. 23, 2010 (with translation).

* cited by examiner

*Primary Examiner* — Kenneth E. Peterson
*Assistant Examiner* — Jennifer Swinney
(74) *Attorney, Agent, or Firm* — Oliff PLC

(57) ABSTRACT

Provided is a cutter that is applicable to a cutting device with variable structures and that allows exchange of a cutting blade safely and smoothly with a simple structure. The present invention provides a cutter comprising: a slider; a holder member that retains a cutting blade; and a removing-and-installing member that removes or installs the holder member from or into the slider in a condition that the cutting blade is shielded with a cover member, wherein the cover member is provided with a projection portion while the holder member is provided with a groove portion, and when the removing-and-installing member is installed into the slider along with the holder member, the projection portion is adapted to travel in the groove portion so as to expose a cutting edge of the cutting blade through a cutout.

11 Claims, 13 Drawing Sheets

CUTTER

TECHNICAL FIELD

The present invention relates to a cutter used by installing it in a cutting device, the cutting device cutting sheets by sliding a cutting blade. The present invention especially relates to a cutter that improves safety and performance when exchanging a cutting blade.

BACKGROUND ART

Regarding a cutter installed in a cutting device in which to cut sheets by sliding a cutting blade, a holder retaining a circular cutting blade is generally installed at a slider that is allowed to travel in the cutting direction thereof. In such a cutter, the holder is rotatively provided at the slider. By supplying a cutout to the holder, the cutout making the cutting edge of the cutting blade partially exposed, when exchanging the cutting blade, the holder is rotated so as to shield the cutting edge. This technique is disclosed in Patent Document 1 (see below).

When the cutting blade is exchanged, the holder is removed from the slider. The cutting blade is then taken off from the holder for exchanging with a new cutting blade. Here, from a locked condition that a projection portion provided at the outer periphery of the holder is secured at the slider, a lever is operated so as to release the locked condition. A dial is then operated so as to rotate the holder. Accordingly, the cutting edge of the cutting blade is shielded with the holder.

In addition, in order to exchange the cutting blade without touching thereof, Patent Document 2 (see below) has proposed a so-called cassette-type cutter that allows exchanging the whole holder retaining the cutting blade to a new holder.

[Patent Document 1] Japanese Patent Application Laid-open No. Hei 9-123088

[Patent Document 2] Japanese Patent Application Laid-open No. 2002-239266

DISCLOSURE OF THE INVENTION

Problems to be Solved by the Invention

As regards the cutter disclosed by Patent Document 1, it however needs a mechanism in which to lock the rotation of the holder. This not only complicates its structure but also makes required an additional lever operation for releasing the locked condition before a dial operation rotating the holder. This bothers users. Further, when the lever operation is performed, there is a risk that users may touch the cutting blade.

On the other hand, as regards the cutter disclosed by Patent Document 2, the cutting edge is normally exposed from the holder. Accordingly, when exchanging the cutter, there is a risk that users may touch the cutting blade.

In view of the problems described above, it is an object of the present invention to provide a cutter that is applicable to variable types of cutting devices, and to allow exchange of a cutter blade safely and smoothly with a simple structure.

Means for Solving the Problem

In order to achieve the above objects, the present invention provides a cutter that is installed in a cutting device, the cutter comprising: a slider that is travelable in a cutting direction; a holder member that is removably installed in the slider and that retains a cutting blade; and a removing-and-installing member that removes or installs the holder member from or into the slider in a condition that the cutting blade is shielded with a cover member, wherein the cover member is provided with a projection portion while the holder member is provided with a sliding path, the projection portion is adapted to travel on the sliding path through operation that the removing-and-installing member is installed into the slider along with the holder member, and a cutting edge of the cutting blade is adapted to be exposed through cutout provided at the cover member.

Effects of the Invention

In the cutter according to the present invention, when the holder member is removed from the slider, the cutting blade is shielded with the cover member. On the other hand, when the holder member is installed to the slider, the projecting portion of the cover member is adapted to travel on the sliding path of the holder member. Accordingly, it makes possible that the cutting edge of the cutting blade is exposed through the cutout of the cover member. As discussed, the displacement of the cover member is restricted in a range that the projecting portion travels. The displacement making the cutting edge of the cutting blade exposed can be thus achieved by designs of the sliding path. This can actualize highly secured cutters with a simple structure.

Further, through installation of the holder member to the slider, the cover member is displaced so as to make the cutting edge of the cutting blade exposed through the cutout. Accordingly, as soon as the installation has been completed, cutting operation will become operable. When removing and installing the holder member to the slider, the cutting blade is shielded with the cover member so that there is a low risk that users may touch the cutting edge. Accordingly, as soon as the removing and installing of the holder member has been completed, the cutting edge of the cutting blade is exposed allowing users to perform cutting operation. Users thus safely perform sequential operations from the removing and installing of the slider to cutting of sheets.

BRIEF DESCRIPTION OF THE DRAWINGS

FIG. 2 shows an exploded view of the cutter in FIG. 1 where

FIG. 3 shows the structure of the cutter where

FIG. 4 shows a holder member that has been detached from the slider where

FIG. 5 is a perspective view that shows a condition of each part when the holder member is detached from the slider through operation of the removing-and-installing member where

BEST MODES FOR CARRYING OUT THE INVENTION

Best modes for carrying out the present invention will be explained with reference to the accompanying drawings. Here, the embodiments of the present invention will not be limited to the following embodiments but will be applicable to other embodiments as long as the objects of the present invention can be achieved.

Figure 1:
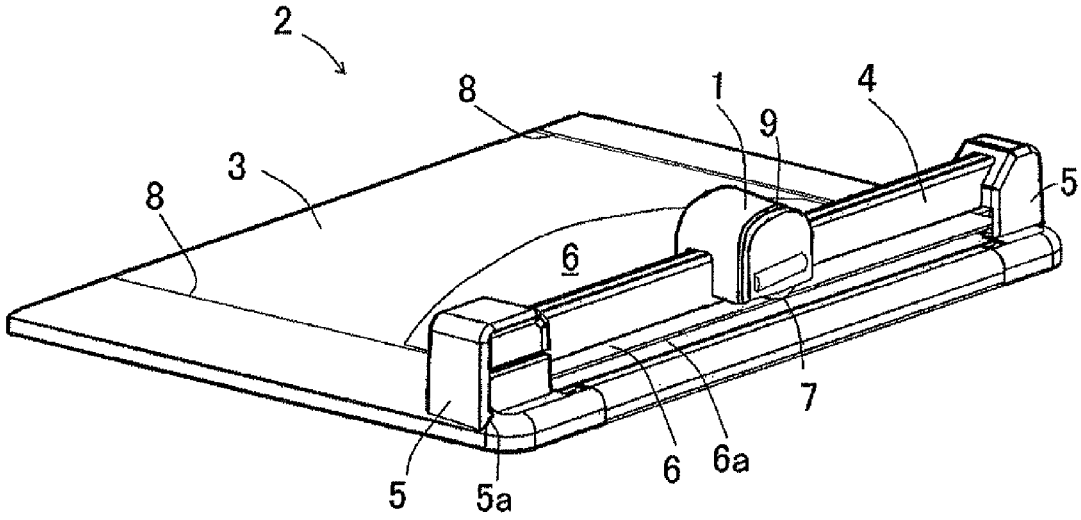
FIG. 1 is a perspective view that shows a cutting device into which a cutter according to the embodiments of the present invention is installed.

FIG. 1 is a perspective view that shows a cutting device 2 into which a cutter 1 according to the embodiments of the present invention is installed. The cutting device 2 is composed of a base 3; a rail 4, a supporting member 5; a fixing plate 6; and the cutter 1 according to the embodiments of the present invention. By traveling the cutter 1 along the rail 4, sheets placed on the base 3 are cut with a circular cutting blade 7.

The base 3 is a base on which a sheet material such as paper is placed. Each end of the base 3 has step 8 to which edges of the sheet material are abutted. At the central portion of the base 3 on which the sheet material is placed may have a squared scale or any mark correspondent to a standard paper size. One side portion of the base 3 has the rail 4 that is shiftable in a vertical direction. This rail 4 is supported with the supporting member 5 provided at each end of the base 3. Further, the rail 4 is installed at a height apart form the surface of the base 3 at a certain distance.

In the supporting member 5, a spring (not shown) is provided so as to support the rail 4 in an upwardly urged condition. In an initial condition, by means of the urging force of the spring, the rail 4 is positioned at a height approximately 2 to 4 mm apart from the surface of the base 3. On one side of the supporting member 5, a lock mechanism 5*a* for fixing the rail 4 is provided. This lock mechanism 5*a* is structured as that an elastically deformable member which is U-shaped in section is rotatively provided at the supporting member 5 and secured at the supporting member 5 at a rotation end.

At the bottom end portion of the rail 4, the fixing plate 6 is installed in order to fix the sheet material placed on the base 3. By pressing down the rail 4 to be locked through the lock mechanism 5*a*, the sheet material is pressed on the base 3 by the fixing plate 6. In a condition that the sheet material is fixed on the base 3, by sliding the cutter 1 with a hand press, the sheet material is cut with the cutting blade placed at the bottom end of the cutter.

The fixing plate 6 is composed of, for example, a transparent synthetic-resin member. A marginal portion 6*a* of the fixing plate 6, which is a side that the sheet material is cut, is colored different from the plate surface of the fixed plate 6. In a condition where the cutting blade 7 is positioned at the marginal portion 6*a* of the fixed plate 6, the cutter 1 according to the embodiment of the present invention is slidably installed at the rail 4. A portion 9 at which the cutting blade of the cutter 1 is arranged is colored different from other portions. When viewing the portion 9 from the top of the cutter 1, the portion 9 in this color is made correspondent to the marginal portion 6*a* of the fixing plate 6. Accordingly, by matching the portion 9 at which the cutting blade is arranged or the marginal portion 6*a* of the fixing plate 6 to a cutting line, a desired position on the sheet material can be cut.

Figure 2A:
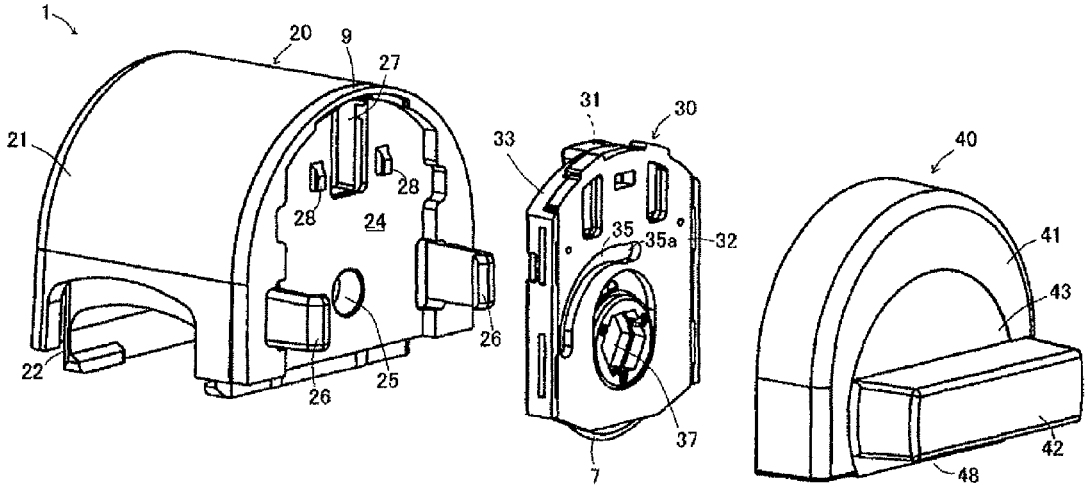
FIG. 2A is a perspective view seen form the side of a slider.
Figure 2B:
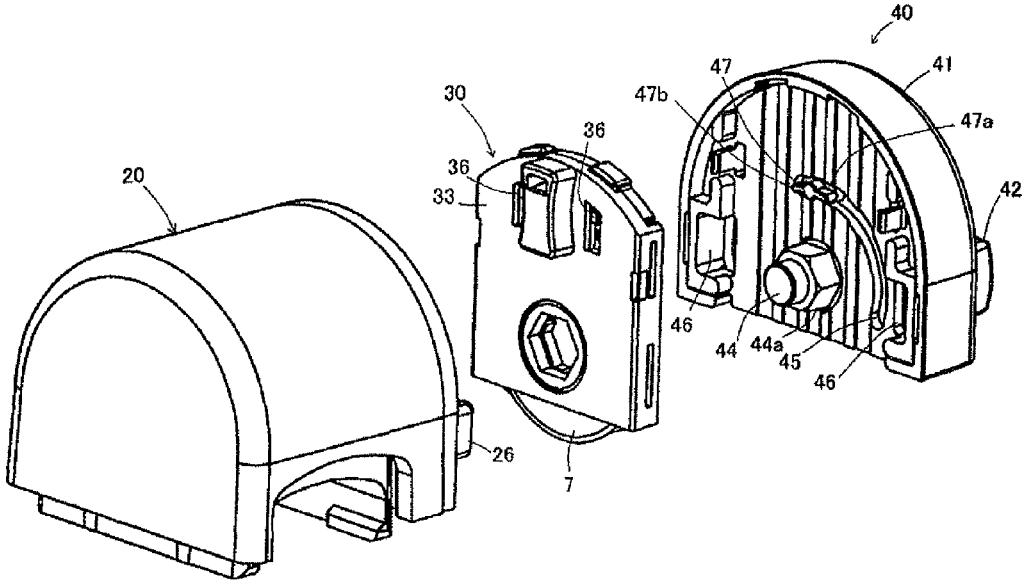
FIG. 2B is a perspective view seen from a removing-and-installing member.

Next, the structure of the cutter 1 according to the embodiments of the present invention will be explained with reference to FIG. 2. FIG. 2 is a perspective view where the cutter 1 installed into the cutting device 2 is exploded. This cutter 1 is composed of: a slider 20; a holder member 30; and a removing-and-installing member 40. The slider 20 is slidably installed at the rail 4 of the cutting device 2, and is composed of: a main portion 21 that holds the holder member 30; a ground portion 22 that is installed at the rail 4; and a spring 23 that intervenes between the main portion 21 and the ground portion 22. See FIG. 3B.

The main portion 21 has a concave portion 24 on the side wall surface thereof for housing the holder member 30. In a condition where the holder member 30 is housed in the concave portion 24, the main portion 21 is urged upward by means of the spring 23 provided between the main portion 21 and the ground portion 22. The side wall surface of the main portion 21 is also composed of: an axial pore 25 into which a dial shaft 44 of the removing-and-installing member 40 is inserted; a fitting portion 26 on which the removing-and-installing member 40 is mounted; a space portion 27 into which the attaching portion of the spring 31 of the holder member 30 is housed; and a pressing portion 28 that operates a shielding plate 32 when the holder member 30 is removed. The holder member 30 as well as the removing-and-installing member 40 can be mounted on the side wall surface of the main portion 21.

Within the holder member 30, the circular cutting blade 7 is housed. This cutting blade 7 can form any cutting line corresponding to the shape of the circumference of the circular cutting blade 7, the shape being, for example, a straight line, a wave line or a perforation. Variable kinds of the cutting blades 7 are housed in each of holders. As discussed hereinabove, by housing the cutting blade 7 in the holders, the whole new holder member 30 becomes exchangeable according to the cutting lines.

This holder member 30 is composed of: the cutting blade 7; the shielding plate 32 shielding the cutting blade 7; a retaining portion 33 holding the cutting blade 7; and the spring 31 intervening between the retaining portion 33 and the shielding plate 32 (see FIG. 4). The retaining portion 33 includes a concave portion in which the circular cutting blade 7 is housed. Along the blade surface of the cutting blade 7 housed in the concave portion, the shielding plate 32 is slidably arranged.

The shielding plate 32 is made of a platy material with an area that can shield the cutting blade 7. At the center of the shielding plate 32 has a vertically-elongated long hole 34. In addition, at the upper portion of the long hole 34, in such a manner as to surround the long hole 34, an approximately arc-shaped groove portion 35 is arranged. This groove portion 35 is a slide path on which a later-explained projection portion 47 of the removing-and-installing member 40 travels. This groove portion 35 is a vertically elongated curvilinear form so as to allow vertical movement of the shielding plate 32, the groove portion 35 being vertically longer than an arc-shaped slit 44 provided at the removing-and-installing member 40. At the upper end of the groove portion 35 has a securing section 35*a* for securing the projection portion 47 of the removing-and-installing member 40.

Between the shielding plate 32 and the retaining portion 33, the spring 31 intervenes. This spring 31 is for making the shielding plate 32 to be slid relative to the retaining portion 33. The projection portion 47 of the removing-and-installing member 40 travels at the groove portion 35 of the shielding plate 32 and secured with the securing section 35*a* placed at the upper portion of the groove portion 35. Accordingly, the spring 31 is compressed being able to place the shielding plate 32 upward. That is, when the holder member 30 is mounted at the slider 20, the shielding plate 32 is elevated so as to make the cutting edge of the cutting blade 7 exposed. When the holder member 30 is removed from the slider 20, the shielding plate 32 moves downward so as to shield the cutting edge of the cutting blade 7.

Figure 3A:
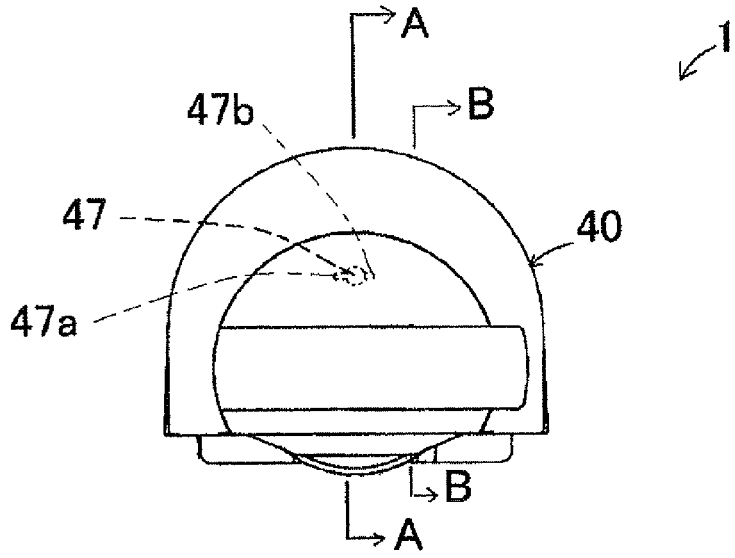
FIG. 3A is a front view seen from the removing-and-installing member.
Figure 3B:
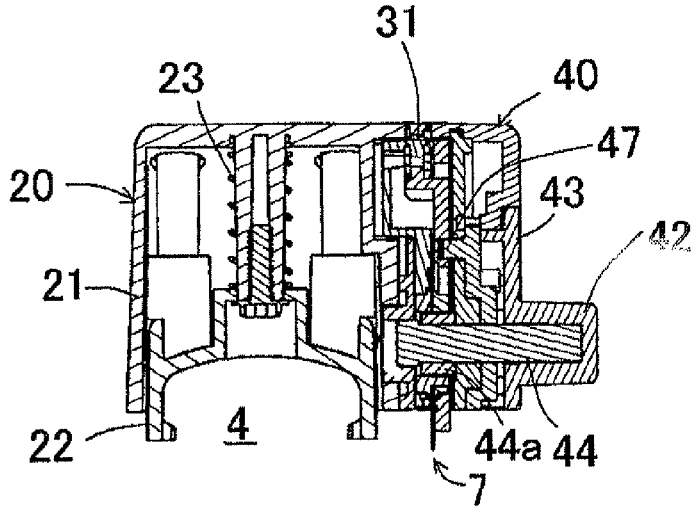
FIG. 3B is a sectional view along line A-A of FIG. 3A.
Figure 3C:
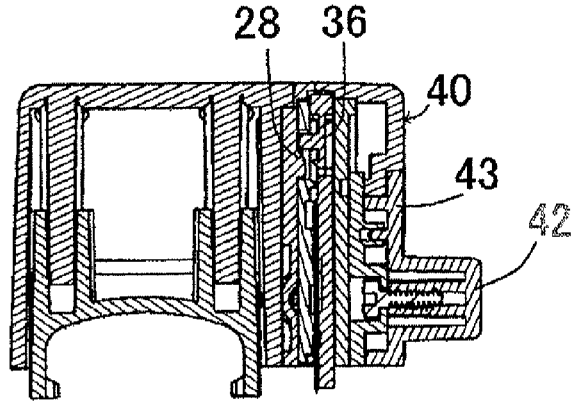
FIG. 3C is a sectional view along line B-B of FIG. 3A.
Figure 4A:
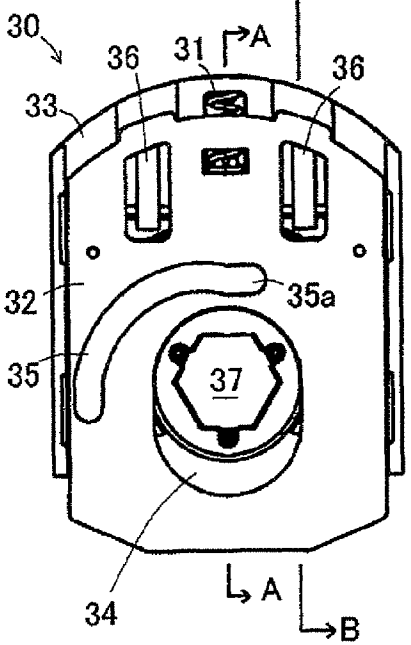
FIG. 4A is a front view seen from the removing-and-installing member.
Figure 4B:
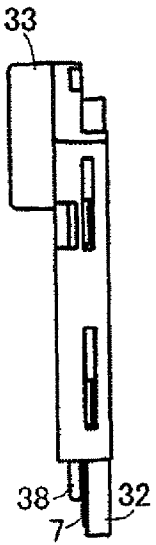
FIG. 4B is a side view.
Figure 4C:
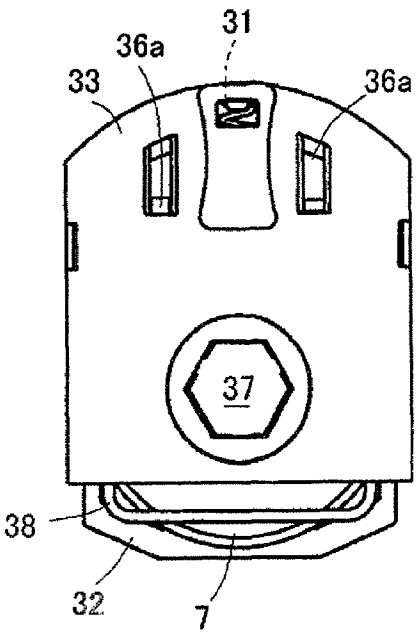
FIG. 4C is a rear view.
Figure 4D:
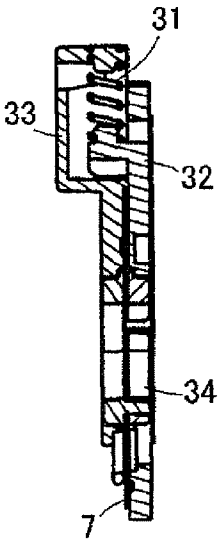
FIG. 4D is a sectional view along line A-A of FIG. 4A.
Figure 4E:
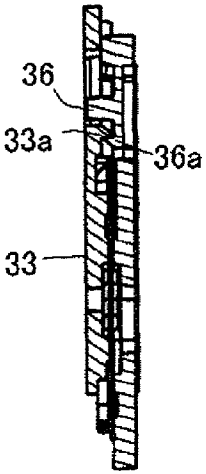
FIG. 4E is a sectional view along line B-B of FIG. 4A.

At the projection portion 47 of the removing-and-installing member 40, reinforcing walls 47*a*, 47*b* that extend along the traveling direction of the projection portion 47 are provided (see FIG. 3). Against the compressive force of the spring 31, the engaging condition of the projection portion 47 relative to the securing section 35*a* of the groove portion 35 can be maintained. By making the projection portion 47 of the removing-and-installing member 40 engaged with the securing section 35*a* of the holder member 30, while the holder member 30 is being installed at the slider 20, a plate spring 36 provided at the shielding plate 32 is elastically deformed toward the side of the removing-and-installing member 40 by means of the pressing portion 28 of the slider 20. Further, when the engagement of the projection portion 47 toward the securing section 35*a* is released, and when the holder member 30 is removed from the slider 20, a fixing portion 36*a* provided at the top end of the plate spring 36 is adapted to secured at a fixed area 33*a* provided at the retaining portion 33 so as to be locked position where the shielding plate 32 is placed downward. Accordingly, while the holder member 30 is removed, it makes possible not to expose the cutting edge of the cutting blade 7 from the shielding plate 32.

At the center of the retaining portion 33, a polygonal axial hole 37 is provided. The later-explained dial shaft 44 of the removing-and-installing member 40 is inserted into and fitted in the axial hole 37. Further, through a protective material 38 provided below the retaining portion 33, the circular cutting blade 7 is rotatively retained between the shielding plate 32 and the protective material 38. This holder member 30 is installed at the slider 20 by means of the removing-and-installing member 40 in such a manner that the retaining portion 33 is directed toward the side of the slider 20 while the shielding plate 32 is directed toward the side of the removing-and-installing member 40.

The removing-and-installing member 40 for installing the holder member 30 into the slider 20 is composed of: a main body 41; a dial-shaped operation portion 42; and a cover member 43. The main body 41 is formed into a cap shape that can house the holder member 30 between the slider 20 and the main body 41. At the center of the main body 41 is provided with an axial hole into which the dial shaft 44 is inserted. Further, at the circumference of the axial hole, an arc-shaped slit 45 is arranged (see FIG. 2B). Still further, at the inner wall portion of the main body 41 is provided with a fitted portion 46 into which the fitting portion 26 of the slider 20 is fitted.

The operation portion 42 is a dial for performing the removing and installing of the slider 20. By rotating a dial-shaped handle, the cover member 43 is rotated so as to extrude or intrude the cutting blade 7. The dial shaft 44 is provided in such a manner as to extend from the operation portion 42. The dial shaft 44 is inserted into the axial hole of the main body 41. A base portion 44*a* of the dial shaft 44 is made so as to be fitted into the axial hole 37 of the holder member 30. The holder member 30 can be thus retained in a stable manner.

The cover member 43 is formed integrally with the operation member 42. This cover member 43 is formed as that a circle is partially cut out into a circular segment. The cover member 43 is adapted to rotate at the dial shaft 44 relative to the main portion 41. At the back surface of the cover member 43 is provided with the projection portion 47. The reinforcing walls 47*a*, 47*b* extend from both sides of the projection portion 47 in its traveling direction. Accordingly, the projection portion 47 can maintain its engaging condition with the securing section 35*a* of the groove portion 35. This projection portion 47 travels in the arc-shaped slit 45 of the main body 41 so as to restrict the rotation range of the cover member 43 when the cutting blade 7 is installed. The cutting edge of the cutting blade 7 is thus exposed from a cutout 48 of the cover member 43 only in a necessary amount.

Figure 5A:
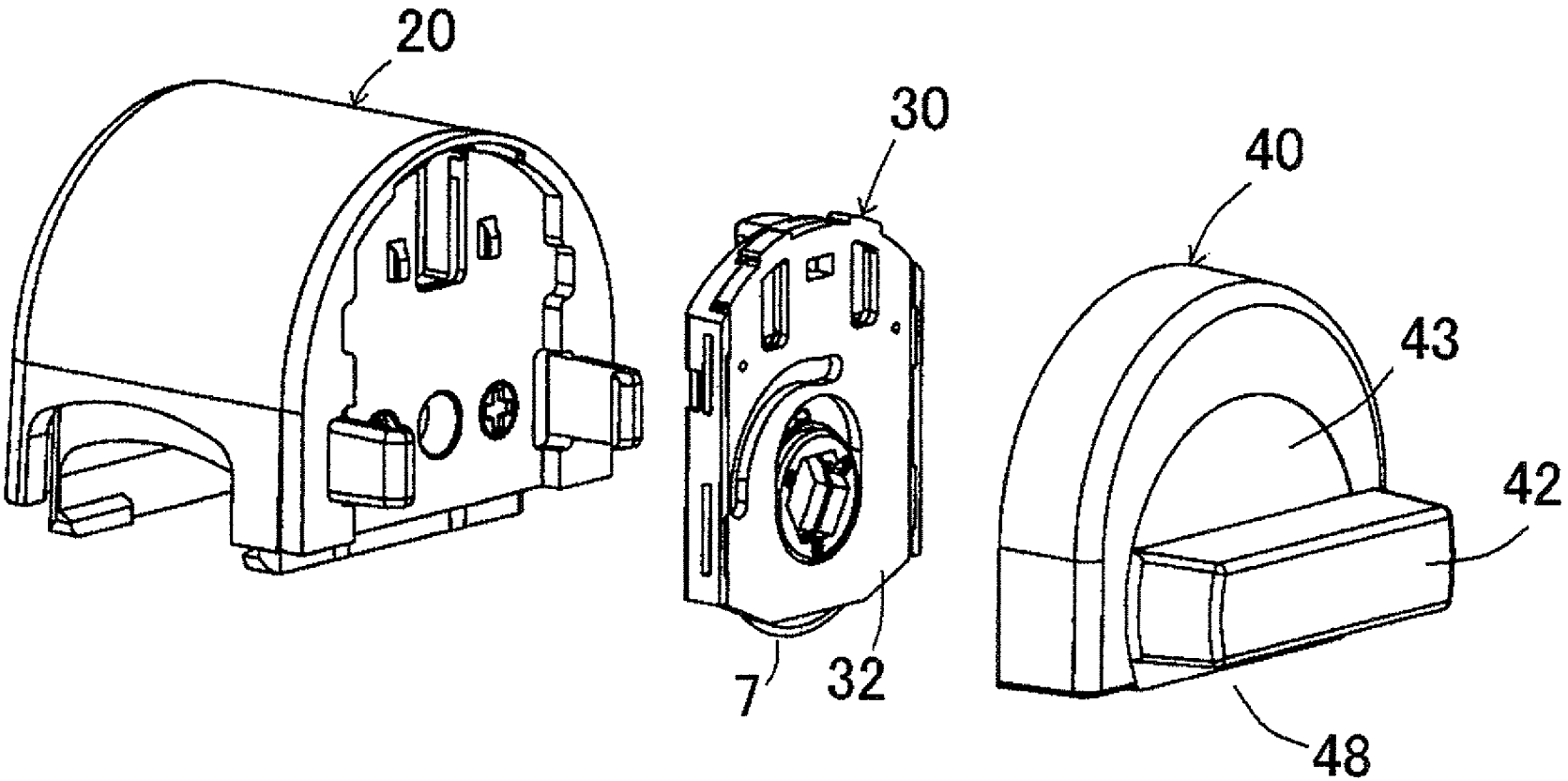
FIG. 5A is a condition before operation.
Figure 5B:
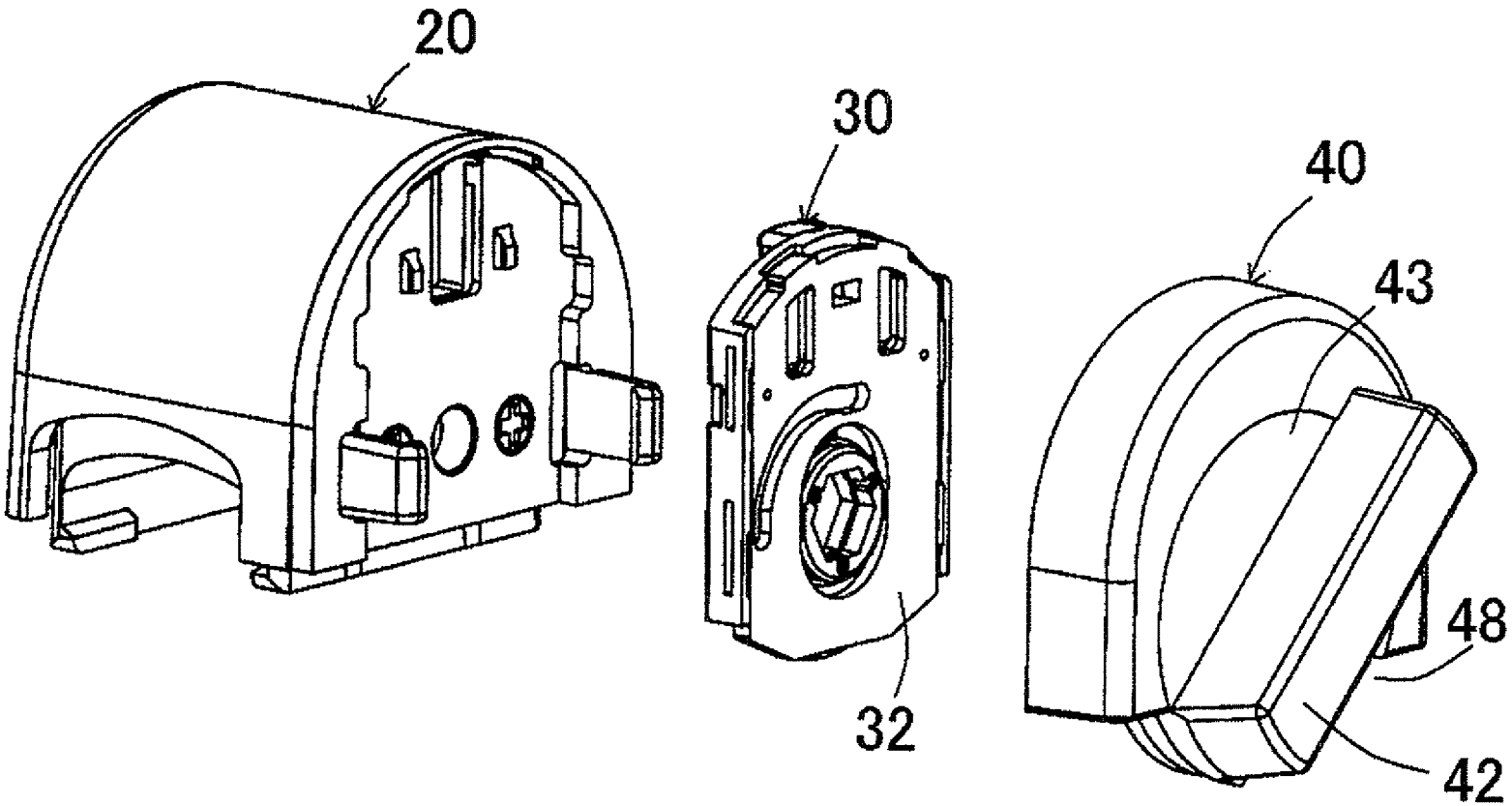
FIG. 5B is a condition during operation.
Figure 5C:
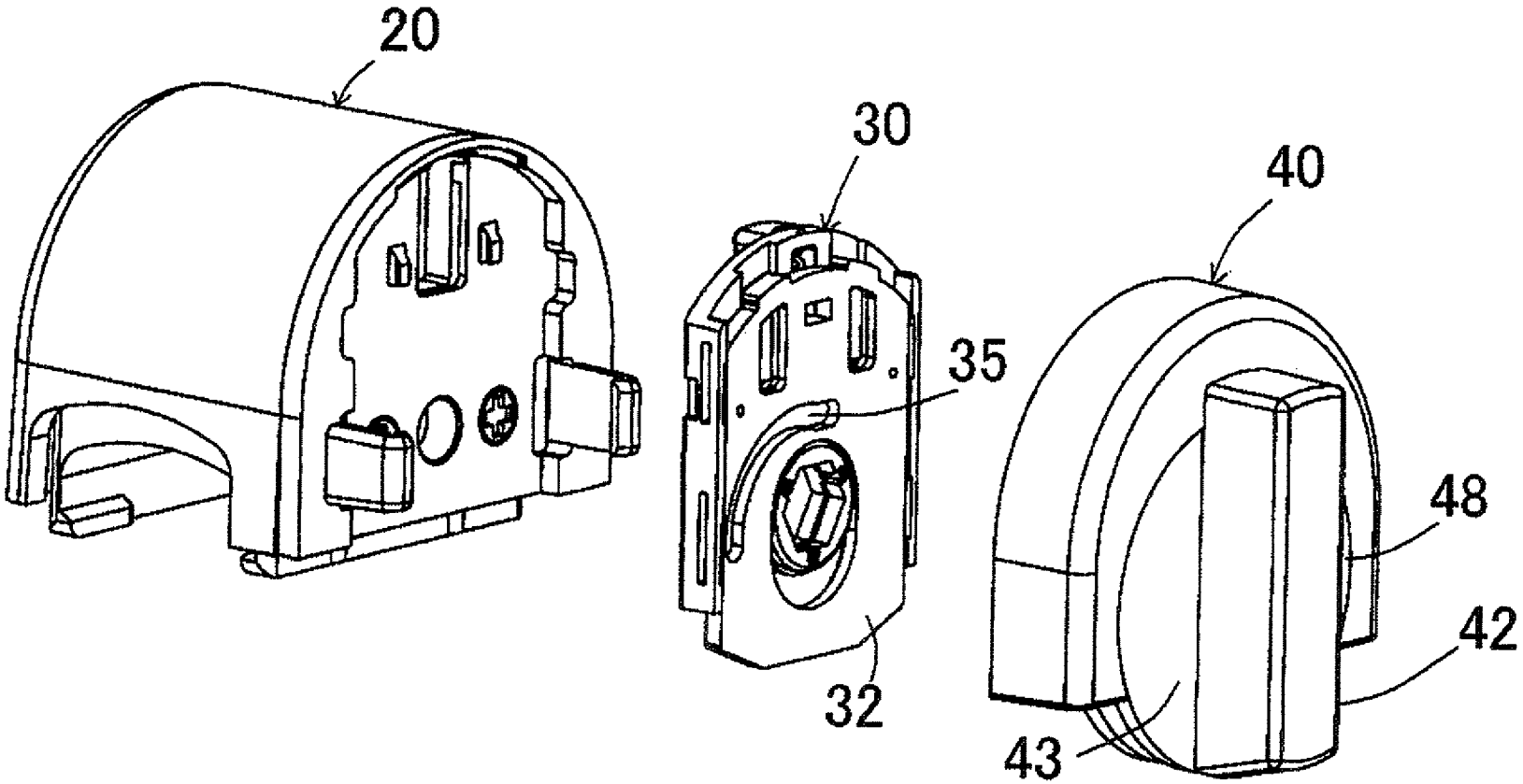
FIG. 5C is a condition after operation.
Figure 6A:
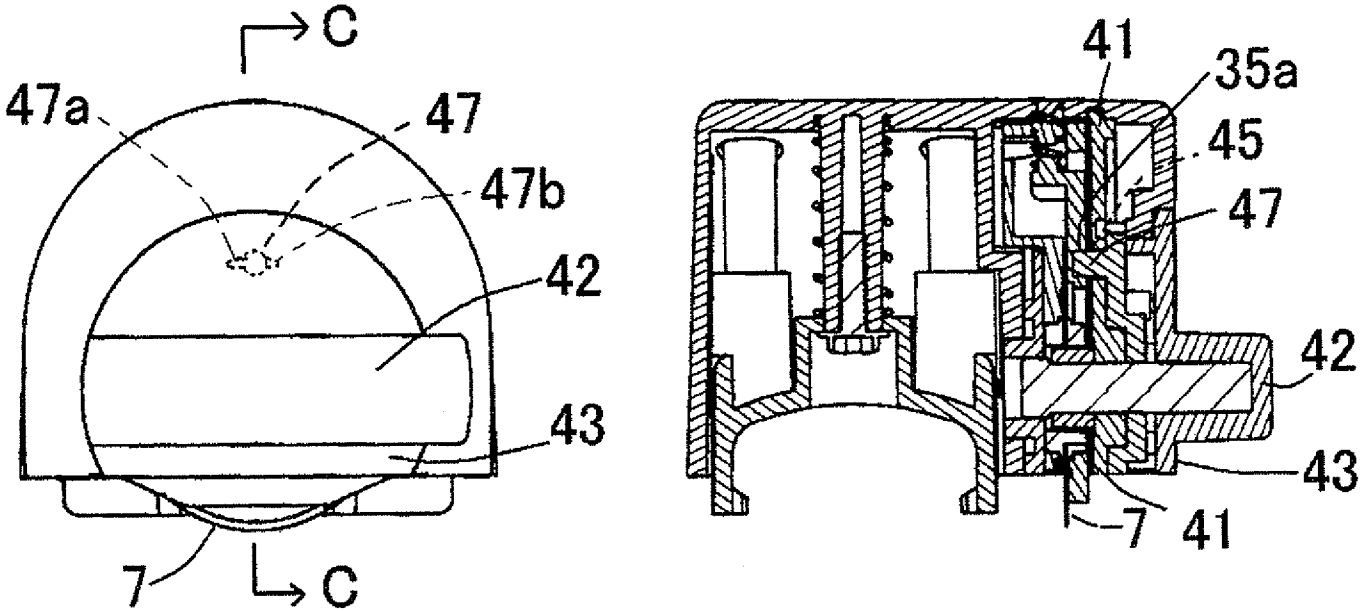
FIGS. 6A-C are explanatory views that show the position of a projecting portion in FIGS. 5A-C and the condition of the cover member corresponding thereto.
Figure 6B:
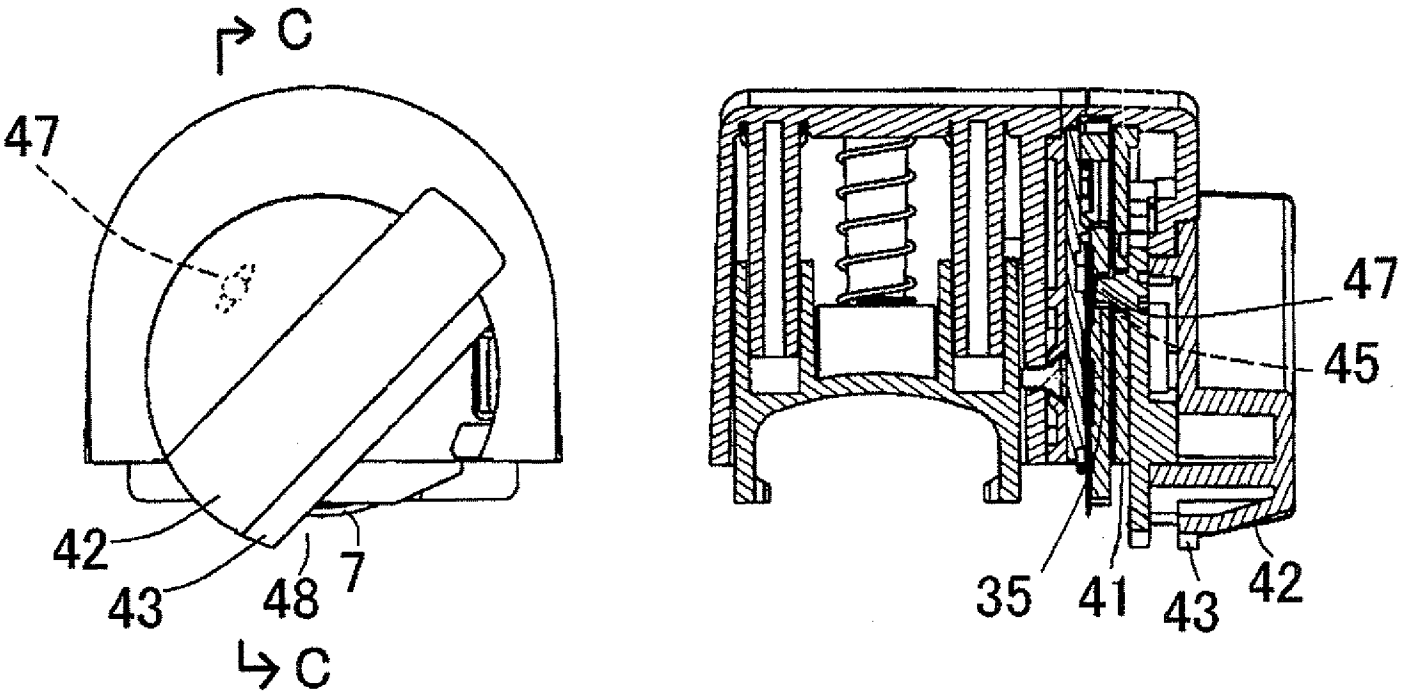
Figure 6C:
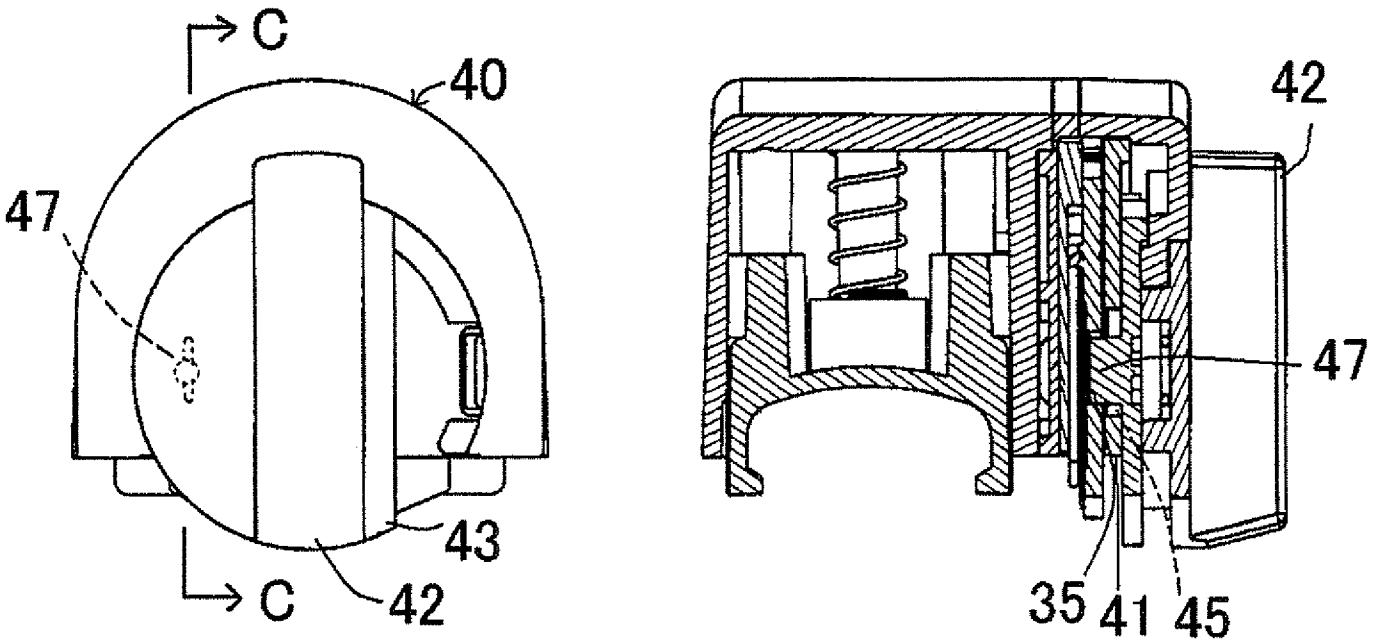
Figure 7A:
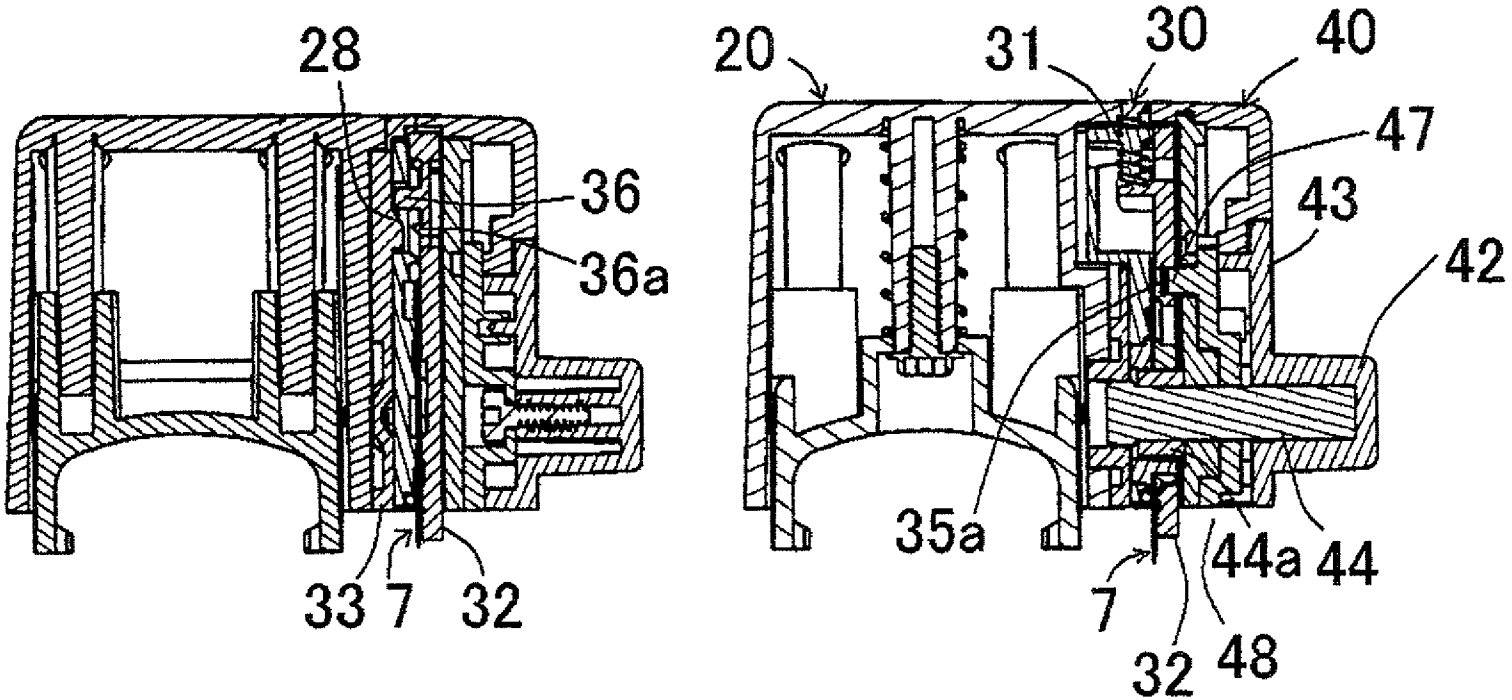
FIGS. 7A-C are explanatory views that shows a shielding plate and a corresponding condition of a spring in FIGS. 5A-C.
Figure 7B:
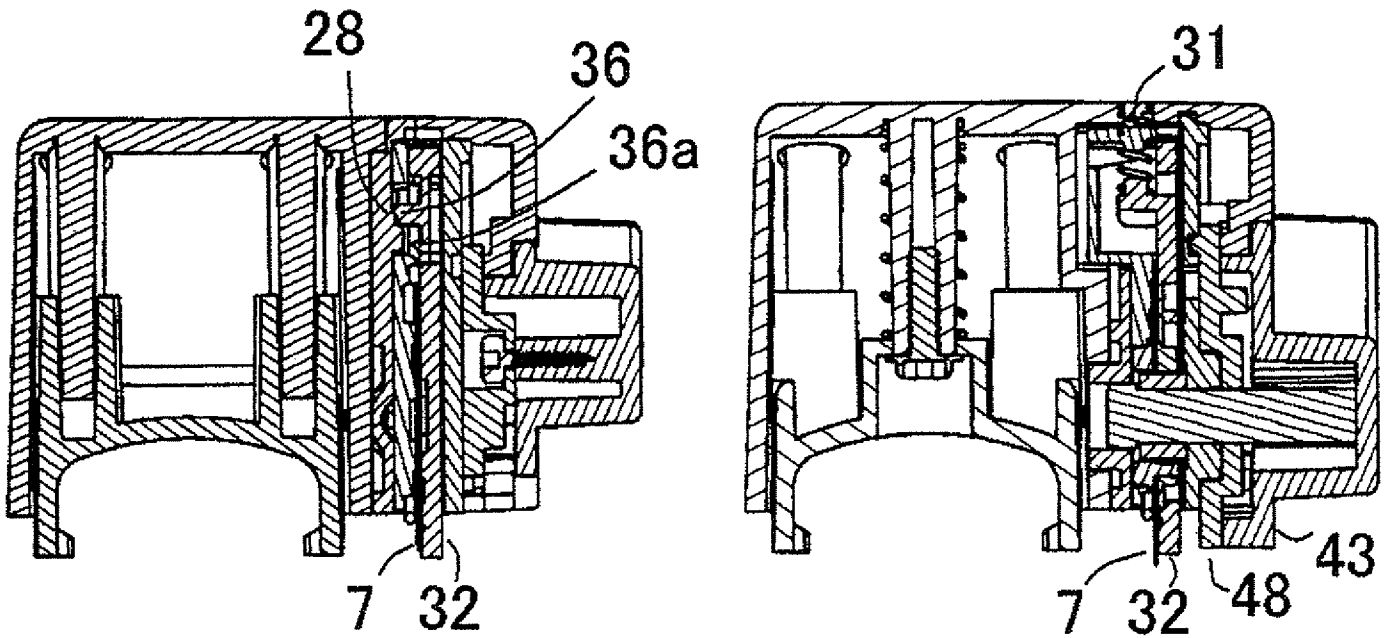
Figure 7C:
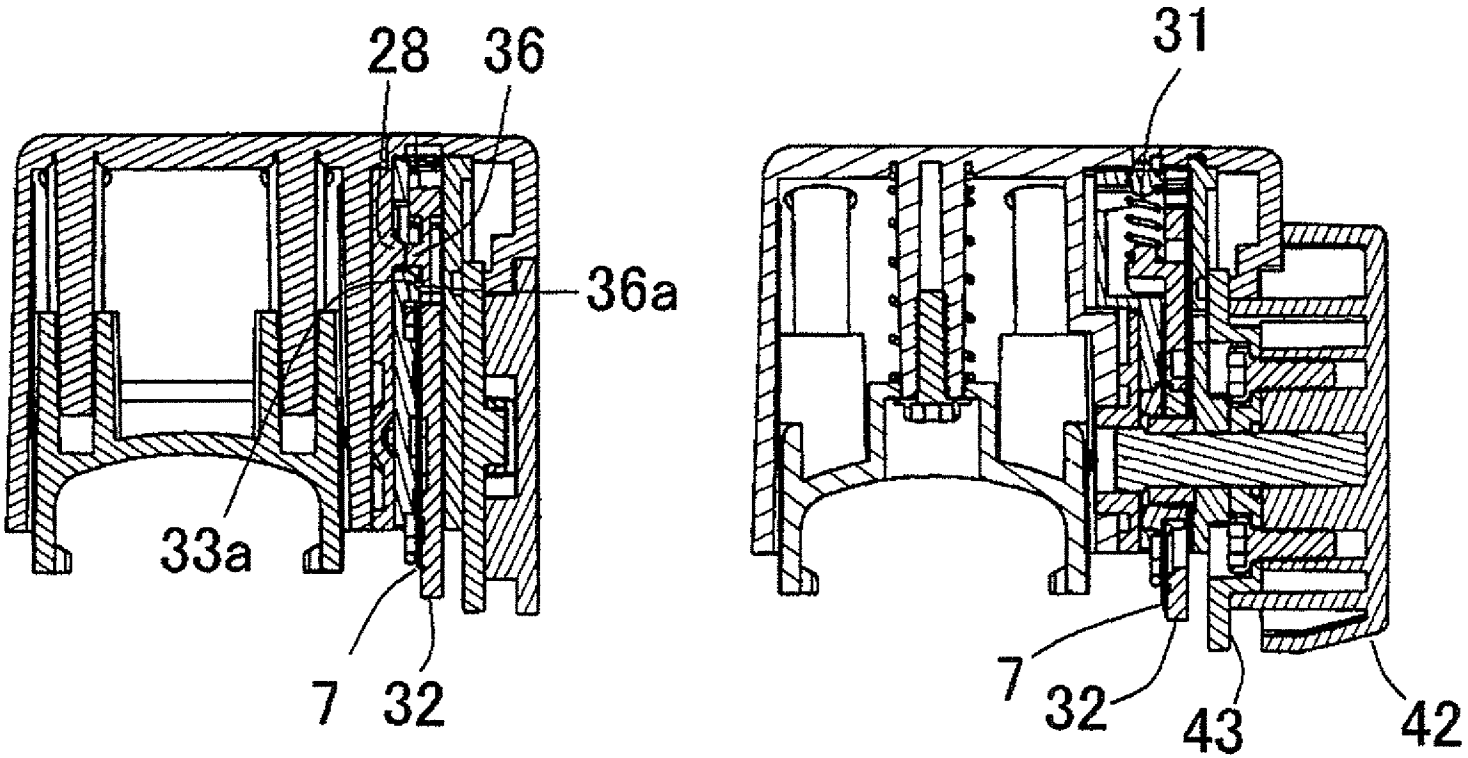

In the cutter 1 with the structure described hereinabove, some conditions where the cutting blade 7 is exchanged will be explained with reference to FIGS. 5 to 7. In each of the drawings, Figure A indicates a condition before a removing operation, Figure B indicates a condition during the removing condition, and Figure C indicates a condition after the removing condition. The right-side drawing in FIG. 6 is a sectional view along line C-C of the left-side drawing in FIG. 6. The right-side drawing in FIG. 7 is a sectional view along line B-B in FIG. 4. The left drawing in FIG. 7 is a sectional view along line A-A in FIG. 4. First, the operation portion 42 in a condition of FIG. 5A is rotated so as to make it to be in a condition of FIG. 5C. The holder member 30 and the removing-and-installing member 40 are then removed from the slider 20.

Here, by rotating the operation portion 42, the cover member 43 is adapted to rotate along with the operation portion 42 so as to shield the cutting edge of the cutting blade 7. At this time, the projection portion 47 of the cover member 43 has been secured at the securing section 35*a* of the groove portion 35 of the holder member 30 through the slit 45 of the main body 41. From this condition, the projection portion 47 travels downward along the groove portion 35 so as to be secured at the bottom end portion of the groove portion 35 (see FIG. 6). Accordingly, the fixation of the projection portion 47 relative to the securing section 35*a* is released whereby the spring 31 intervening between the shield plate 32 and the retaining portion 33 is elastically deformed in an extended direction. The spring 31 then presses down the shielding plate 32 so as to shield the cutting blade 7 (see FIG. 7). Here, the plate spring 36 of the shield plate 32 travels downward at the inclined pressing portion 28 of the slider 20 with force of the spring 31 to be extended. The plate spring 36 is then engaged with the fixed area 33*a* of the retaining portion 33 through the fixing portion 36*a* provided at the top end of the plate spring 36. With this structure, while the holder member 30 is removed, the cutting blade 7 can be locked in a shielded condition.

Then, the holder member 30 that has been removed from the slider 20 will be exchanged to with new one. While retaining the new holder member 30, it is installed into the slider 20 along with the removing-and-installing member 40. Here, since the dial operation portion 42 is rotated, the projection portion 47 travels at the approximately arc-shaped groove portion 35 of the holder member 30 in a direction from down to up so as to be secured at the securing section 35*a* at the upper end of the groove portion 35. Here, the cutting blade 7 has been shielded with the cover member 43 as shown in FIG. 6C. In this condition, the cover member 30 is rotated so as to reveal the cutout 48 (see FIG. 6B). When installation to the slider 20 has been completed, the cutting edge of the cutting blade 7 is exposed. Cutting operation will then become available at once (see FIG. 6A).

While the holder member 30 and the removing-and-installing member 40 installing to the slider 20, the cutting blade 7 is shielded with the cover member 43. Thus, users hardly touch the cutting edge of the cutting blade 7. In the cutter 1 according to the embodiments of the present invention, the whole holder member 30 is replaced contributing to high safety. Especially, when the holder member 30 is removed from the slider 20, the fixing portion 36*a* of the shielding plate 32 and the fixed area 33*a* of the retaining portion 33 are adapted to engage with each other. The down position of the shielding plate 32 can be thus remained so as to prohibit the cutting edge of the cutting blade from being exposed from the shielding plate. As a result, safety is further improved.

A sliding path allowing the projection portion 47 of the cover member 43 to travel is the groove portion 35 provided at the shielding plate 32. When the projection portion, 47 is positioned at the upper end of the groove portion 35, the compressed condition of the spring 31 is maintained. Accordingly, the rotation of the cover member 43 that exposes the cutting edge of the cutting blade 7 from the cutout 48 can connect with an operation that exposes the cutting edge of the cutting blade 7 from the shielding plate 32. Exchange of the cutting blade 7 can be thus smoothly operated.

In this case, since the groove portion 35 working as the sliding path of the projection portion 47 is formed into an approximately arc shape, when the dial-shaped operation portion 42 of the removing-and-installing member 40 is rotated so as to install the holder member 30 to the slider 20, the cutting edge of the cutting blade 7 can be precisely exposed from the cutout 48 of the cover member 43. This mechanism can be actualized with a simple structure. Here, the "approximately arc shape" means a round arc, or a shape that a linear displacement is applied to an arc shift.

Then, the groove portion 35 on which the projection portion 47 travels is provided at the shielding plate 32 that shields the cutting blade 7 within the holder member 30. When the projection portion 47 is positioned at the upper end of the groove portion 35, the projection portion 47 is secured in the groove portion 35 so as to keep the compressive condition of the elastic member. The cutting blade can be thus exposed through the installing operation of the slider 20. Accordingly, this mechanism can be realized with a simple structure. Since the projection portion 47 travels within the arc-shaped slit 45 of the main body 41, the rotation range of the cover member 43 when the cutting blade 7 is installed will be restricted. The cutting edge of the cutting blade 7 is to be exposed from the cutout 48 of the cover member 43 only in a necessary amount. Further, since the reinforcing walls 47*a*, 47*b* extend from both sides of the projection portion 47 in its traveling direction, when the projection portion 47 engages to the securing section 35*a* of the groove portion 35, the engaging state is maintained. On the other hand, when the projection portion 47 slides on the groove portion 35, the projection portion 47 is guided by the reinforcing walls 47*a*, 47*b* contributing to smooth traveling.

Here, the cutter 1 according to the embodiments of the present invention has been explained as the cassette-type cutting blade 7 allowing that the whole holder can be exchanged. However, the cutter 1 may be structured as that only the cutting blade 7 is exchangeable. The shielding plate 32 may not be a mechanism, which allows it to ascend and descend, or may not be provided with the shielding plate itself. In case that the shielding plate 32 does not ascend or descend, the curved contour formed by the groove portion 35 at the holder member 30 (that is, the sliding path) does not need to be orbit as that the linear displacement of the shielding plate 32 is added to an arc shift performed by the projection portion 47. Accordingly, the curved contour becomes an arc shape according to the rotation of the operation portion 42. The projection portion 47 may be any shape as long as the projection portion 47 can travel on the sliding path of the holder member 30. Further, the cutting blade 7 may not need to be circular, and the operation portion 42 may also not need to be a dial type.

INDUSTRIAL APPLICABILITY

The present invention is applicable to any cutter used in every field, such as a business field, an industrial field, an agricultural field, etc.

DESCRIPTION OF THE REFERENCE NUMERALS

1: Cutter, 2: Cutting device, 3: Base, 4: Rail, 5: Supporting member, 5*a*: Lock mechanism, 6: Fixing plate, 7: Cutting blade, 8: Step, 9: Portion, 20: Slider, 21: Main body, 22: Ground portion, 23: Spring, 24: Concave portion, 25: Axial pore, 26: Fitting portion, 27: Space portion, 28: Pressing portion, 30: Holder member, 31: Spring, 32: Shielding plate, 33: Retaining portion, 33*a*: Fixed area, 34: Long hole, 35: Groove portion (Sliding path), 35*a*: Securing section, 36: Plate spring, 36*a*: Fixing portion, 37: Axial hole, 38: Protective material, 40: Removing-and-installing member, 41: Main body, 42: Operation portion, 43: Cover member, 44: Dial shaft, 44*a*: Base portion, 45: Slit, 46: Fitted portion, 47: Projection Portion, 47*a*/47*b*: Reinforcing walls, 48: Cutout

The invention claimed is:

1. A cutter that is installed in a cutting device, the cutter comprising:

a slider that is travelable in a cutting direction;

a holder member that is removably installed in the slider and that retains a cutting blade, wherein the holder member comprises:

a retaining portion that retains the cutting blade, a shielding plate that is slidably provided relative to the retaining portion so as to shield the cutting blade, and an elastic member that intervenes between the shielding plate and the retaining portion;

a removing-and-installing member that removes or installs the holder member from or into the slider in a condition that the cutting blade is shielded with a cover member, wherein the cover member is provided with a projection portion while the holder member is provided with a sliding path; and an operation portion provided at the removing-and-installing member is displaced in a direction that the holder member is removed from the slider so as to extend the elastic member in order to descend the shielding plate; wherein the sliding path is a groove portion provided at the shielding plate, and when the projection portion is positioned at an upper end of the groove portion, the projection portion is secured in the groove portion so as to compress the elastic member, the projection portion is adapted to travel on the sliding path through operation that the removing-and-installing member is installed into the slider along with the holder member, and a cutting edge of the cutting blade is adapted to be exposed through a cutout provided at the cover member.

2. The cutter according to claim 1, wherein the sliding path is approximately an arc shape, the operation portion provided at the removing-and-installing member is rotatable in the direction that the holder member is installed into the slider, and the cover member is adapted to rotate only at a certain angle so as to expose the cutting edge of the cutting blade from the cutout.

3. The cutter according to claim 2, wherein the holder member comprises: the retaining portion that retains the cutting blade; the shielding plate that is slidably provided relative to the retaining portion so as to shield the cutting blade; and the elastic member that intervenes between the shielding plate and the retaining portion, and the operation portion provided at the removing-and-installing member is displaced in the direction that the holder member is removed from the slider so as to extend the elastic member in order to descend the shielding plate.

4. The cutter according to claim 3, wherein a plate spring is provided at the shielding plate, the plate spring being elastically deformable when the holder member is removed from the slider, and being secured at the retaining portion so as to maintain a descending position of the shielding plate.

5. The cuter according to claim 4, wherein reinforcing walls extend from both sides of the projection portion in a sliding direction.

6. The cuter according to claim 3, wherein reinforcing walls extend from both sides of the projection portion in a sliding direction.

7. The cuter according to claim 2, wherein reinforcing walls extend from both sides of the projection portion in a sliding direction.

8. The cutter according to claim 1, wherein a plate spring is provided at the shielding plate, the plate spring being elastically deformable when the holder member is removed from the slider, and being secured at the retaining portion so as to maintain a descending position of the shielding plate.

9. The cuter according to claim 8, wherein reinforcing walls extend from both sides of the projection portion in a sliding direction.

10. The cuter according to claim 1, wherein reinforcing walls extend from both sides of the projection portion in a sliding direction.

11. The cutter according to claim 10, wherein a plate spring is provided at the shielding plate, the plate spring being elastically deformable when the holder member is removed from the slider, and being secured at the retaining portion so as to maintain a descending position of the shielding plate.

* * * * *